United States Patent [19]

Veith

[11] 4,390,174

[45] Jun. 28, 1983

[54] CONTROL HEAD FOR CONTROLLING THE SUCTION PATH OF A SUCTION ROLLER

[75] Inventor: Dieter Veith, Neuwied, Fed. Rep. of Germany

[73] Assignee: Winkler & Dunnebier Maschinenfabrik und Eisengiesserei GmbH & Co., Neuwied, Fed. Rep. of Germany

[21] Appl. No.: 244,835

[22] Filed: Mar. 18, 1981

[51] Int. Cl.[3] ..... B65H 3/08

[52] U.S. Cl. ..... 271/108; 251/314

[58] Field of Search ..... 271/98, 108, 96; 251/210, 304, 352, 314

[56] References Cited

U.S. PATENT DOCUMENTS

| | | | |
|---|---|---|---|
| 2,764,407 | 9/1956 | Alix | 271/108 |
| 2,911,008 | 11/1959 | Du Bois | 251/314 X |
| 3,312,464 | 4/1967 | Rehm | 271/96 |
| 4,279,412 | 7/1981 | Glatz | 271/108 |

*Primary Examiner*—Richard A. Schacher

*Attorney, Agent, or Firm*—Allison C. Collard; Thomas M. Galgano

[57] ABSTRACT

A control head for controlling the suction path of a suction roller used for feeding sheets, cut paper, or the like, wherein the control head is provided with at least one suction and one fresh air conduit and is stationarily mounted adjacent to a rotatable suction roller. Suction holes are provided in the suction roller which discharge into a supply bore which may be connected to a suction air source or an outside atmosphere depending on the position of the suction roller. The control edge of the fresh air conduit is so shaped that, during the overflow of the fresh air conduit, at first only a small cross-sectional opening is provided for venting of the supply bore of the suction roller, which opening gradually increases and finally reaches the full diameter of the fresh air conduit.

5 Claims, 5 Drawing Figures

CONTROL HEAD FOR CONTROLLING THE SUCTION PATH OF A SUCTION ROLLER

The invention relates to a control head for controlling the suction path of a suction roller and the feeding of sheets, cut paper, or the like. More particularly, it relates to a control head provided with at least one suction and one fresh air conduit stationarily mounted adjacent to a rotatable suction roller having suction holes which discharge into a supply bore for communication with a suction air or vacuum source or the outside atmosphere, via said conduits, depending upon the position of the suction roller.

It is disadvantageous in hitherto known control heads of this type that the opening of the fresh air conduit or canal is accompanied by considerable noise. Due to the steep flank vacuum wave which is generated due to the opening of the fresh air conduit, a very loud boom is, in turn, generated which is very noticeable from the remainder of the machine noise.

It has previously been tried to eliminate this loud boom by adding silencers. Indeed, the noise can be lowered, however, the silencers must be very voluminous, so that they don't hinder the "breathing" of the suction roller in an undue manner.

It is therefore an object of the invention to afford a noise damping of control heads of the aforementioned type without the use of silencers.

This object of the invention is obtained in that a control edge of the fresh air conduit is so shaped that, initially, during the overflow of the fresh air conduits, only a small cross diameter opening is present for venting the supply bore of the suction roller, which opening gradually increases and finally reaches the full cross diameter of the fresh air conduit.

In a particular embodiment of the invention, this is achieved by providing a groove having a tapered cross section defined by an angle of some degrees which runs from the fresh air conduit in the direction of the suction conduit.

As tests have shown, the groove may be short and small in its cross section, so that its presence hardly has any influence on the discharge point of the suction cylinder. Yet, a lowering of the noise level by about 6 db is obtained. Considering the small investment, this is indeed a considerably high value.

Other objects and features of the present invention will become apparent from the following detailed description when taken in connection with the accompanying drawings which disclose one embodiment of the invention. It is to be understood that the drawings are designed for the purpose of illustration only and are not intended as a definition of the limits of the invention.

In the drawings, wherein similar reference characters denote similar elements throughout the several views.

Figure 1:
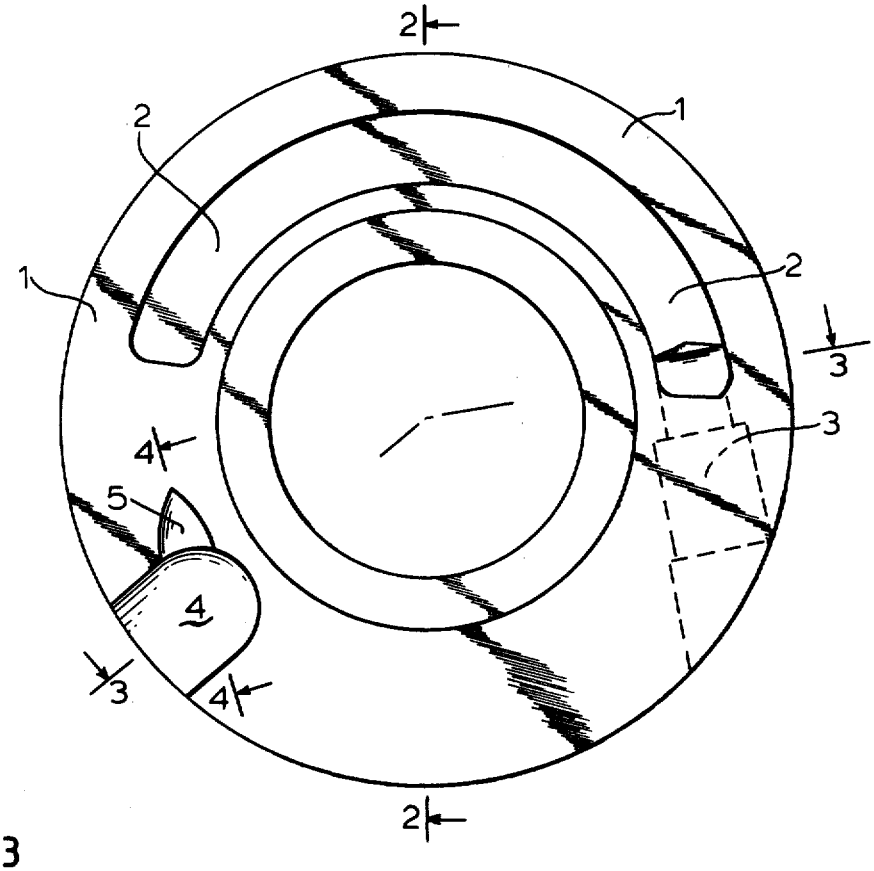
FIG. 1 is a schematic front view of a control head having single suction and fresh air conduits embodying the present invention.
Figure 3:
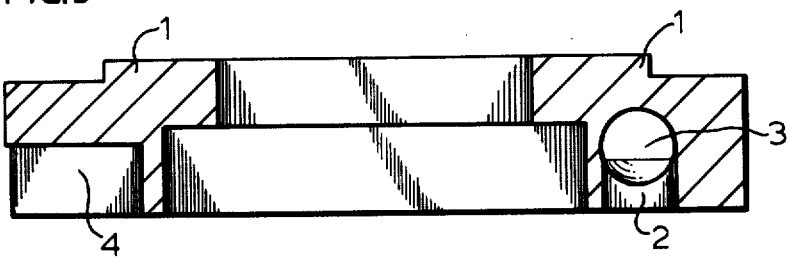
FIG. 3 is a sectional view through the control head along line 3—3 of FIG. 1.
Figure 4:
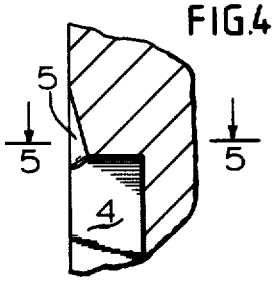
FIG. 4 is a sectional view through the control head along line 4—4 of FIG. 1.

Referring now in detail to the drawings, the invention control head consists of a disk-like base element 1 which, as is particularly evident from FIG. 1, has two conduits formed therein-namely, an arc-like suction conduit 2 which communicates with a suction air or vacuum source (not shown) by means o a bore 3 and a pipe or hose line (not shown) and a radially, outwardly-extending fresh air conduit 4.

Figure 5:
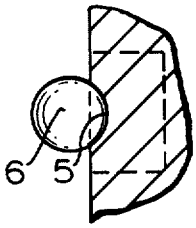
FIG. 5 is a sectional view through the fresh air conduit of the control head along lines 5—5 of FIG. 4.
Figure 2:
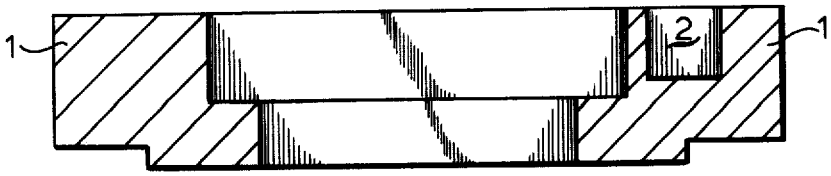
FIG. 2 is a sectional view through the control head along line 2—2 of FIG. 1.

In contrast to the commonly known control heads, fresh air conduit 4 is provided with a groove 5 which runs in a tapered manner along a path of some angle degrees from the fresh air conduit 4 in the direction of suction conduit 2. As shown in FIG. 5, the groove 5 has an arc-like cross section. This groove is formed by an obliquely-disposed milling cutter 6 shown in FIG. 5.

The effectiveness of the control head is best explained in conjunction with a suction roller. As is known, such a suction roller is provided with a plurality of suction holes or bores on its surface, which discharge into at least one supply bore which, in turn, discharges onto one of the front face of the suction roller.

Opposite to this front face, the control head is mounted in the form of a stationary disk. Thereby, the supply bore which discharges from the front face of the suction roller is admitted with suction air as long as it is disposed opposite to the suction conduit 2 during rotation of the suction roller. Upon further rotation of the suction roller, the supply bore leaves the area of the suction conduit and is separated from the vacuum source as soon as the trailing bore edge runs beyond this area as well. After a few angle degrees later, the advancing or leading edge of the supply bore reaches the tip of groove 5, whereby initially a very small free cross-sectional opening is generated which, during the further movement of the suction roller, increases and through which fresh air penetrates into the suction roller and gradually decreases or vents the prevailing vacuum therein. This gradual cross-sectional enlargement increases into a dramatic enlargement as soon as the advancing edge of the supply bore has reached the control edge of the fresh air conduit. Thereby, in contrast to the commonly known control head, no air stream is suddenly generated, but an already prevailing flow is merely strengthened. In addition, a part of the vacuum is already reduced due to the very weak flow through groove 5 at this point in time. Thereby, the created vacuum wave is also lower when the control edge of the fresh air conduit 2 arrives and is also less steep at the flanks as compared with commonly known control heads without groove 5. The combination of the two reduces the noise generation.

Thus, while only one embodiment of the present invention has been shown and described, it will be obvious that many changes and modifications may be made thereunto, without departing from the spirit and scope of the invention.

What is claimed is:

1. In a control head for controlling the suction path of a suction roller and the feeding of sheets, cut paper or the like, of the type having at least one suction conduit and at least one fresh air conduit both opening onto one side of said control head which is stationarily disposable adjacent to a rotatable suction roller having suction holes formed therein which discharge into a supply bore which, depending on the rotatable position of said suction roller, may communicate with said suction conduit or said fresh air conduit and, in turn, a vacuum source or the atmosphere, respectively, the improvement comprising:

said fresh air conduit having a leading control edge which communicates with a venting conduit opening onto said surface of said control head and positioned generally between said suction and fresh air conducts which venting conduit is so dimensioned and shaped that, during initial communication of said supply bore with said fresh air conduit, only a small free cross-sectional opening provided by said conduit is available for establishing communication between said fresh air conduit and said supply bore, so as to permit a gradual venting of said supply bore, which opening gradually increases and finally equals the full cross-sectional diameter of said fresh air conduit, when said fresh air conduit and said supply bore are in complete alignment with one another.

2. The control head of claim 1, wherein said conduit comprises a groove having a tapered longitudinally cross section which runs in a direction from the fresh air conduit towards the suction conduit.

3. The control head of claim 2, wherein the length of said groove is only a fraction of the distance between said fresh air conduit and said suction conduit.

4. The control head of claim 2 or 3, wherein said groove has a circular arc-like transverse cross section.

5. The control head of claim 1, wherein said control head has a generally annular disc shape and has an arcuate generally U-shaped channel opening onto said one surface thereof which serves as said suction conduit and a radially-outwardly-extending groove opening onto said one surface of said control head, as well as the outer edge thereof, which serves as said fresh air conduit and a stepped central bore formed therethrough.

* * * * *